US009206014B2

(12) United States Patent
Sato et al.

(10) Patent No.: US 9,206,014 B2
(45) Date of Patent: Dec. 8, 2015

(54) WIRE BUNDLING DEVICE AND WIRE BUNDLING METHOD

(71) Applicant: NITTOKU ENGINEERING CO., LTD., Saitama (JP)

(72) Inventors: Takahiro Sato, Fukushima-ken (JP); Tsutomu Sakai, Fukushima-ken (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 416 days.

(21) Appl. No.: 13/688,871

(22) Filed: Nov. 29, 2012

(65) Prior Publication Data

US 2013/0181084 A1 Jul. 18, 2013

(30) Foreign Application Priority Data

Jan. 16, 2012 (JP) ..... 2012-5755

(51) Int. Cl.

| | |
|---|---|
| ***B65H 54/02*** | (2006.01) |
| ***H01F 41/06*** | (2006.01) |
| ***B65H 51/015*** | (2006.01) |
| ***B65H 75/32*** | (2006.01) |

(52) U.S. Cl.

CPC ..... *B65H 54/02* (2013.01); *B65H 51/015* (2013.01); *B65H 75/32* (2013.01); *H01F 41/0625* (2013.01); *B65H 2701/36* (2013.01)

(58) Field of Classification Search

CPC ..... H02G 1/04; H02G 1/08; B23Q 3/103; B23P 19/04; B21F 13/00; B21F 15/02; B65H 51/015; B65H 54/02; B65H 75/32; H01F 41/0625

See application file for complete search history.

(56) References Cited

FOREIGN PATENT DOCUMENTS

| | | | |
|---|---|---|---|
| DE | 2438225 | A1 | 2/1976 |
| JP | S55163826 | A | 12/1980 |
| JP | 2001297935 | A | 10/2001 |
| JP | 2003-012230 | | 1/2003 |
| JP | 2007037272 | A | 2/2007 |

*Primary Examiner* — Debra Sullivan

(74) *Attorney, Agent, or Firm* — Laurence Greenberg; Werner Stemer; Ralph Locher

(57) ABSTRACT

A plurality of relatively long wires having the same diameter are bundled together to obtain a bundle wire in a continuous wire bundling process. A wire bundling device includes a plurality of reels rotated by a rotating drive and wind a wire while a first end is engaged. A wire second-end pressing device collects and presses a second end of each of a plurality of wires having a predetermined length which is fed from a single spool and individually wound around each of a plurality of reels. The wires are withdrawn in a collected state from the reels by a withdrawing device between the plurality of reels and the wire second-end pressing device. The wire second-end press includes first and second pressing devices. The reels are rotated by an electric motor with a contact roller that rotates in contact with an outer circumference of the reel. The motor can be moved so that the contact roller selectively makes contact with the outer circumferences of the reels.

5 Claims, 14 Drawing Sheets

WIRE BUNDLING DEVICE AND WIRE BUNDLING METHOD

CROSS-REFERENCE TO RELATED APPLICATION

This application claims the priority, under 35 U.S.C. §119, of Japanese patent application JP 2012-5755, filed Jan. 16, 2012; the prior application is herewith incorporated by reference in its entirety.

BACKGROUND OF THE INVENTION

Field of the Invention

The present invention relates to a wire bundling device and a wire bundling method for bundling a plurality of relatively long wires having the same diameter together.

In the related art, a wire bundling device that bundling a plurality of wires such as magnet coils of an electric motor to form a bundle wire and supplies the bundle wire to a coil winding machine has been proposed. This wire bundling device includes a pair of fixed pulleys disposed with a predetermined gap interposed, a plurality of pairs of movable pulleys disposed so as to be movable between the pair of fixed pulleys, a single wire supplied from a single bobbin, a wire fixing portion that fixes a distal end of a wire that is alternately laid between one of the pair of movable pulleys and one of the pair of fixed pulleys, a control wire that is alternately laid between the other one of the pair of movable pulleys and the other one of the pair of fixed pulleys, a control wire fixing portion that fixes a first end of the control wire, and a control wire supply portion configured to supply the control wire and be capable of winding a second end portion of the control wire (for example, see Japanese Patent Application Laid-open No. 2003-12230).

According to the wire bundling device, when the single wire supplied from the single bobbin is alternately laid between one of the pair of movable pulleys and one of the pair of fixed pulleys, a plurality of wires is disposed between the movable pulley and the fixed pulley. Here, when the control wire supply portion winds the control wire that is alternately laid between the other one of the pair of movable pulleys and the other one of the pair of fixed pulleys, it is possible to increase the gap between one of the pair of movable pulleys and one of the pair of fixed pulleys. As a result, it is possible to withdraw a single wire from a single bobbin until a plurality of wires disposed between the movable pulley and the fixed pulley has a desired length. In this case, it is possible to set the tension of each of the plurality of wires so as to have the same value using only one tension adjuster for adjusting the tension of the control wire, for example. Thus, it is possible to easily adjust the tension of a plurality of wires without making a device configuration complex.

However, in this wire bundling device, the plurality of wires having a desired length is obtained by increasing the gap between one of the pair of movable pulleys and one of the pair of fixed pulleys. However, due to an installation space of the wire bundling device, there is a limit on increasing the gap between one of the pair of movable pulley and one of the pair of fixed pulleys. Thus, it is not possible to increase the gap between one of the pair of movable pulleys and one of the pair of fixed pulleys over the limit gap and to obtain a bundle wire having a length that exceeds the limit gap. Thus, in order to obtain a bundle wire made of a relatively long wire, a relatively large wire bundling device is required, and thus, a relatively large installation space for installing the device is required.

Moreover, in the wire bundling device of the related art, a single wire fed from the bobbin is alternately laid between one of the pair of movable pulleys and one of the pair of fixed pulleys, whereby a plurality of wires is disposed between the movable pulley and the fixed pulley. Thus, when the wire fed from the bobbin has a length such that the wire may not form a plurality of wires, an operation of preparing a new bobbin and feeding a new wire having a length such that the wire forms a plurality of wires from the new bobbin is performed. As a result, the wire having a length such that the wire may not form a plurality of wires becomes useless and is discarded. However, the discarded wire has a relatively large length, and the amount of waste increases.

Further, in the wire bundling device of the related art, a plurality of wires is bundled to form a bundle wire, and the bundle wire is supplied to a coil winding machine as it is to be provided for winding. Subsequent bundling is not performed if winding in the coil winding machine is not finished. Subsequent winding is not performed if the subsequent bundling is not performed. Thus, the coil winding machine may not perform winding continuously, and the wire bundling device may not perform bundling continuously. Therefore, there is a demand for a wire bundling device capable of preparing a plurality of wire bundles to perform winding continuously and continuously performing bundling only.

SUMMARY OF THE INVENTION

An object of the present invention is to provide a wire bundling device and a wire bundling method capable of continuously obtaining a bundle of a plurality of wires having the same diameter and such a relatively large length that exceeds the size of an installation space.

Another object of the present invention is to provide a wire bundling device and a wire bundling method obtaining a bundle of a plurality of wires while decreasing the amount of wasted wires being used as much as possible.

A wire bundling device according to the present invention includes a plurality of reels that is rotated by rotating means and winds a wire, a first end of which is engaged; wire second-end pressing means for collecting and pressing a second end of each of a plurality of wires having a predetermined length which is fed from a single spool and wound individually around each of the plurality of reels; and withdrawing means for withdrawing in a collected state the plurality of wires, the second end side of which is pressed by the wire second-end pressing means, from the plurality of reels.

In this case, it is preferable that the wire second-end pressing means includes: first pressing means for releasably pressing the wire; and second pressing means, disposed adjacent to the first pressing means, for pressing the wire when the wire is released at least by the first pressing means. It is also preferable that the rotating means includes: an electric motor for which a contact roller that rotates in contact with an outer circumference of the reel is provided in a rotating shaft thereof; and motor moving means for moving the electric motor so that the contact roller selectively makes contact with the outer circumferences of the plurality of reels.

Moreover, the wire bundling device may further include a cutting and grasping device that cuts the wire which is wound around one reel by a predetermined length and grasps a first end of the cut wire as the first end of the wire fed from the spool and grasps a second end of the cut wire as a second end of the wire which is wound around one of reels by the predetermined length; wire second-end conveying means for guiding the second end of the wire that is wound around one of the reels by the predetermined length to the wire second-end pressing means; and wire first-end conveying means for moving the first end of the wire grasped by the cutting and grasping device from the cutting and grasping device so as to be engaged with another reel.

On the other hand, a wire bundling method according to the present invention includes a wire winding step of winding a predetermined length of wire fed from a single spool around each of a plurality of reels then cutting the wire repeatedly such that the predetermined length of wire is wound around each of a plurality of reels; and a withdrawing step of bundling a plurality of wires, each having the predetermined length, wound separately around the plurality of reels and withdrawing the plurality of wires from the plurality of reels.

In this case, it is preferable that the wire winding step involves collecting and pressing a second end of each of the wires wound respectively around the plurality of reels whenever the wires are wound around the reels, and the withdrawing step involves withdrawing the plurality of wires from the plurality of reels in a state of being collected from the wire second end side. Moreover, it is preferable that a stretching step of stretching the respective wires withdrawn from the plurality of reels is performed between the wire winding step and the withdrawing step. It is also preferable that the pressing of the second end of the wire is performed by first pressing means for releasably pressing the wire and second pressing means, disposed adjacent to the first pressing means, for pressing the wire at least when the wire is released by the first pressing means.

In the wire bundling device and the wire bundling method according to the present invention, since a wire is wound around a reel to obtain a bundle of wires having a length corresponding to the length of the wire wound around the reel, the wire bundling device does not require a relatively large installation space. Moreover, it is possible to obtain a bundle of wires having a relatively large length that exceeds the size of the installation space as long as the wire has a length such that the wire can be wound around the reel.

Moreover, in the wire bundling device and the wire bundling method according to the present invention, although the wire is fed from a single spool, since the wire is cut after being wound around a reel by a predetermined length, only the wire which is fed from the spool and has a length smaller than the predetermined length is discarded. Thus, in the present invention, it is possible to decrease the amount of wasted wires being used as compared to the related art in which a wire having a length such that the wire may not form a plurality of wires is discarded.

Other features which are considered as characteristic for the invention are set forth in the appended claims.

Although the invention is illustrated and described herein as embodied in a wire bundling device and wire bundling method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Hereinafter, best modes for carrying out the invention will be described based on the drawings.

FIGS. 1 to 14 illustrate a wire bundling device 10 according to the present invention. This wire bundling device 10 is a device 10 that bundles a plurality of relatively long wires 11 having the same diameter together. The wire bundling device 10 includes a plurality of reels 12 around which the wire 11 is wound (see FIGS. 1 to 6). In each figure, three orthogonal axes of X, Y, and Z are set such that the Y-axis represents an approximately horizontal longitudinal direction which is an axial direction of the plurality of reels 12, the X-axis represents an approximately horizontal lateral direction which is an extension direction of the wire 11 that is wound around and withdrawn from the plurality of reels 12, and the Z-axis extends in a vertical direction. The configuration of the wire bundling device 10 will be described using this orthogonal coordinate system.

Figure 3:
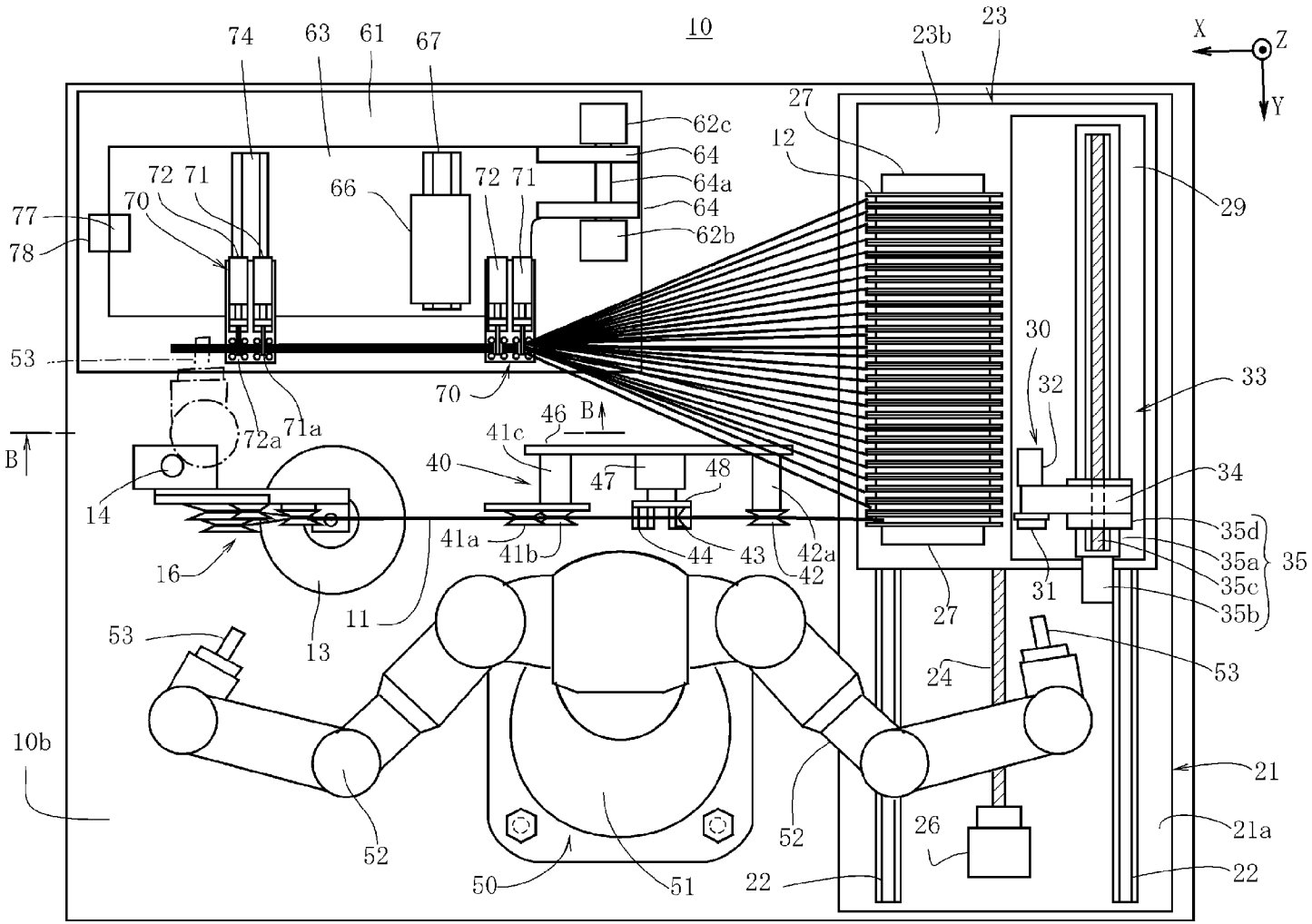
FIG. 3 is a top view corresponding to FIG. 2, illustrating a state where the wire is wound around the last reel by the wire bundling device.
Figure 4:
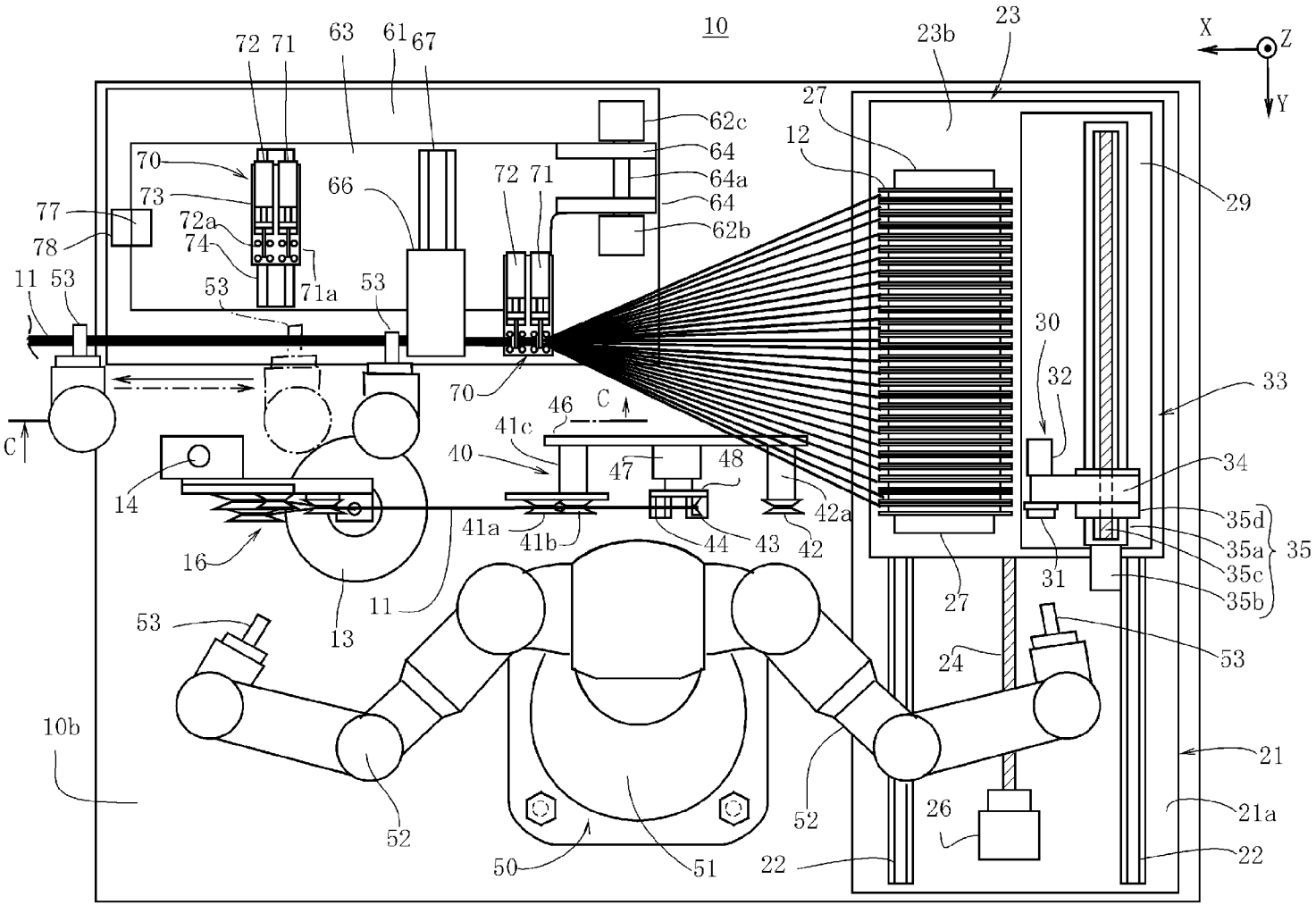
FIG. 4 is a top view corresponding to FIG. 2, illustrating a state where the wire is withdrawn from a plurality of reels of the wire bundling device to obtain a bundle of wires.
Figure 5:
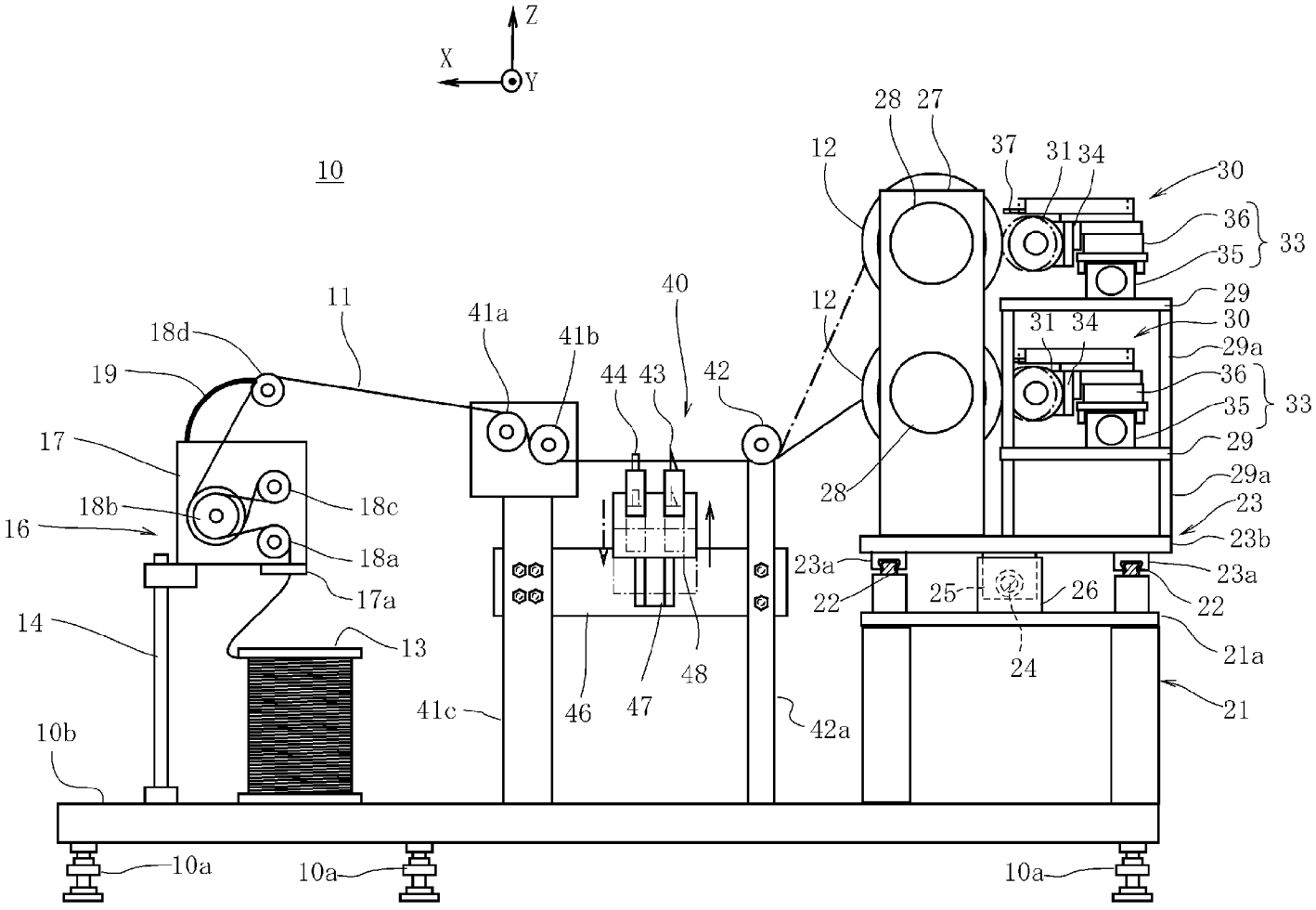
FIG. 5 is an enlarged view along line A-A of FIG. 2.

As illustrated in FIGS. 1 to 5, the wire bundling device 10 includes a base 10*b* that has a plurality of legs 10*a* (see FIG. 5). A spool 13 around which the wire 11 is wound is disposed at a position which is a first end in the X-axis direction of the base 10*b* and is a central portion in the Y-axis direction. The spool 13 is a supply source of the wire 11. In this embodiment, the wire 11 is a coated copper wire used for winding of an electric motor or the like, and a so-called solid wire having a circular cross-section is used. However, the wire 11 may be a so-called rectangular wire having a rectangular cross-section. Moreover, a support rod 14 is formed on a portion of the base 10*b* near the spool 13, and a tension device 16 that applies predetermined tension to the wire 11 that is unwound and fed from the spool 13 is provided in an upper portion of the support rod 14 above the spool 13.

As illustrated in FIG. 5, the tension device 16 includes a support plate 17 provided on the support rod 14, a passing plate 17*a* provided on the support plate 17 so as to pass the wire 11 fed from the spool 13, a shift pulley 18*a* that shifts the wire 11 having passed through the passing plate 17*a*, a pair of winding pulleys 18*b* and 18*c* that winds the wire 11 shifted by the shift pulley 18*a*, and a movable pulley 18*d* that turns the wire 11 having passed through the pair of winding pulleys 18*b* and 18*c*. A base end of a curved rod 19 is fixed to the support plate 17, and the movable pulley 18*d* is formed at a distal end of the curved rod 19. The wire 11 having turned around the movable pulley 18*d* is moved toward a second end side of the X-axis direction, and the movable pulley 18*d* is biased toward the first end side of the X-axis direction by the curved rod 19. The curved rod 19 biases the movable pulley 18*d* so as to prevent the wire 11 from being loosened.

As illustrated in FIGS. 1 to 5, a first table 21 is provided on the second end side in the X-axis direction of the base 10*b*, and a pair of rails 22 that extends in the Y-axis direction is provided on a top plate 21*a* of the first table 21 so as to be spaced in the X-axis direction. A movable mount 23 is movably mounted on the pair of rails 22. As illustrated in detail in FIG. 5, the movable mount 23 includes a linearly moving block 23*a* that is movable on the pair of rails 22 and a pedestal 23*b* that is fixed to the block 23*a* by screwing and extends across the rails 22. The linearly moving block 23*a* is a commercial product sold in pair with the rails 22, and the moving resistance of the movable mount 23 on the rails 22 can be decreased using the linearly moving block 23*a*.

Returning to FIGS. 1 to 5, a conveying screw shaft 24 is provided between the pair of rails 22. A conveying female screw member 25 (see FIG. 5) that screws with the conveying screw shaft 24 is fixed to the movable mount 23 that is provided on the pair of rails 22 so as to be movable in the longitudinal direction. The conveying screw shaft 24 is configured to be rotated by a servo motor 26. When the motor 26 drives and the conveying screw shaft 24 rotates, the conveying female screw member 25 that screws with the conveying screw shaft 24 moves along the pair of rails 22 in the Y-axis direction which is the longitudinal direction thereof together with the movable mount 23.

Support walls 27 are formed at both ends in the Y-axis direction of the movable mount 23. A supporting shaft 28 (see FIG. 5) is provided between the pair of support walls 27 so as to extend in the Y-axis direction. A plurality of reels 12 is disposed closely to each other and is supported by the supporting shaft 28 so that the same axis of rotation thereof extends in the Y-axis direction. In this embodiment, two supporting shafts 28 are provided between the pair of support walls 27 so as to be spaced by a predetermined gap in the Z-axis direction, and the plurality of reels 12 is supported by these two supporting shafts 28. Rotating means 30 for rotating the reels 12 supported in this manner is provided adjacent to these reels 12.

As illustrated in FIGS. 2 to 6, in this embodiment, supporting bases 29 arranged in the plurality of reels 12 at the second end side in the X-axis direction are provided on the movable mount 23 so as to be arranged vertically in the Z-axis direction with a supporting leg 29*a* interposed, and the rotating means 30 for rotating the reel 12 are provided in the supporting bases 29. The rotating means 30 of this embodiment includes an electric motor 32 (see FIGS. 2 to 4) in which a contact roller 31 that rotates in contact with the outer circumference of the reel 12 is provided in a rotating shaft thereof and motor moving means 33 for moving the electric motor 32 so that the contact roller 31 selectively faces the outer circumferences of the plurality of reels 12.

The motor moving means 33 includes a Y-axis direction actuator 35 that moves a mount 34, on which the electric motor 32 (see FIGS. 2 to 4) is mounted, in the Y-axis direction and a cylinder 36 that moves the mount 34 in the X-axis direction. The y axis direction actuator 35 includes a housing 35*a* that extends in the Y-axis direction and is fixed to the supporting bases 29, a pole screw 35*c* that is rotated by a servo motor 35*b*, and a follower 35*d* that screws with the pole screw 35*c* and performs a translation operation. The mount 34 is mounted on the follower 35*d* with the cylinder 36 (see FIG. 6) interposed. As illustrated in detail in FIG. 6, the cylinder 36 interposed between the follower 35*d* and the mount 34 is one that causes the mount 34 to reciprocate in the X-axis direction in relation to the follower 35*d* according to the supply or discharge of compressed air. The cylinder 36 includes a main body 36*a* provided in the follower 35*d* and a slider 36*b* that moves in the X-axis direction in relation to the main body 36*a*, and the mount 34 is fixed to the slider 36*b*. The motor moving means 33 that includes the cylinder 36 and the Y axis direction actuator 35 is configured such that the Y axis direction actuator 35 moves the electric motor 32 in the Y-axis direction with the mount 34 interposed, the contact roller 31 provided in the rotating shaft of the electric motor 32 faces the outer circumference of one reel 12, and the cylinder 36 moves the mount 34 toward the reel 12 as indicated by a one-dot chain-line arrow. In this way, the contact roller 31 selectively makes contact with the outer circumference of the reel 12.

On the other hand, the reel 12 includes a drum portion 12*a* in which the wire 11 is wound around an outer circumference thereof and a pair of disks 12*b* that interposes the drum portion 12*a* from both side in the thickness direction of the drum portion 12*a*. A catching groove 12*c* is formed in the drum portion 12*a* so as to catch the first end of the wire 11 that enters into the catching groove 12*c*. As an example, the catching groove 12*c* is formed so as to extend from the outer circumference of the drum portion 12*a* toward the center of the drum portion 12*a*. In this embodiment, four catching grooves 12*c* are formed around the drum portion 12*a* at intervals of 90°. As indicated by a broken line arrow in FIG. 6, the first end of the wire 11 grasped by a grasping piece 53 of conveying means 50 (see FIGS. 2 to 4) which will be described later is inserted into the catching groove 12*c*. As illustrated in an enlarged view, the first end of the wire 11 is bent at approximately 90° and is caught at the catching groove 12*c*. The number of catching grooves 12*c* is not limited to four, and the number may be one, two, or three as long as the catching groove 12*c* can catch the first end of the wire 11. A position sensor 37 that detects the position of the catching groove 12*c* is formed on the mount 34 on which the electric motor 32 is provided, and the position sensor 37 is configured to move closer to and away from the reel 12 together with the electric motor 32.

An inertial rotation preventing device 38 that prevents free rotation of the reel 12 is provided in the supporting base 29. The inertial rotation preventing device 38 includes a swing rod 38*b* of which the first end is supported on the supporting base 29, a contact 38*a* that is provided at the distal end of the swing rod 38*b*, makes contact with the outer circumference of the disk 12*b* of the reel 12, and becomes a resistance to free rotation of the reel 12, and a spring 38*c* that is interposed between the distal end of the swing rod 38*b* and the supporting base 29 and biases the contact 38*a* so as to be pressed on the outer circumference of the disk 12*b*. In the rotating means 30, when the electric motor 32 is driven in a state where the contact roller 31 makes contact with the outer circumference of the disk 12*b* of the reel 12, the contact roller 31 rotates together with the rotating shaft of the electric motor 32 so that the reel 12 in contact with the rotating contact roller 31 is rotated against the rotational resistance of the reel 12 applied by the inertial rotation preventing device 38.

As illustrated in FIGS. 1 to 5, a cutting and grasping device 40 that cuts the wire 11 which has been fed from the spool 13 with the tension device 16 interposed and been wound around the reel 12 and grasps the wire 11 closer to the spool 13 from the cut point is provided between the spool 13 and the first table 21 where the plurality of reels 12 is provided, that is in the central portion of the base 10*b*. The cutting and grasping device 40 includes a pair of drag pulleys 41*a* and 41*b* that drags the wire 11 fed from the tension device 16 in an S-shape, a reel-side pulley 42 that is disposed closer to the plurality of reels 12 with a predetermined gap from the drag pulleys 41*a* and 41*b* so as to arrange the wire 11 having passed through the drag pulleys 41*a* and 41*b* horizontally and guide the wire 11 to the reel 12, a nipper device 43 that cuts a horizontally arranged portion of the wire 11, and a clamp device 44 that grasps a portion of the wire 11, which is cut by the nipper device 43, closer to the drag pulleys 41*a* and 41*b* from the cut point.

The pair of drag pulleys 41*a* and 41*b* and the reel-side pulley 42 are respectively provided in upper portions of leg members 41*c* and 42*a* that are formed on the base 10*b*, and an attachment plate 46 is provided between the leg members 41*c* and 42*a* that are arranged with a predetermined gap interposed in the X-axis direction. The nipper device 43 and the clamp device 44 are provided on the attachment plate 46 so as to be movable up and down in the Z-axis direction by a cylinder 47. Specifically, the nipper device 43 and the clamp device 44 are provided on an auxiliary plate 48 with a predetermined gap interposed in the X-axis direction, and the auxiliary plate 48 is formed on the attachment plate 46 with the cylinder 47 interposed. The cylinder 47 is configured such that the auxiliary plate 48 can be moved up and down according to the supply of compressed air, and in a state where the auxiliary plate 48 is moved up, the wire 11 that extends horizontally in the X-axis direction between the pair of drag pulleys 41*a* and 41*b* and the reel-side pulley 42 can be cut by the nipper device 43 and be grasped by the clamp device 44. On the other hand, when the auxiliary plate 48 is moved down as indicated by a one-dot chain-line arrow in FIG. 5, the nipper device 43 and the clamp device 44 are moved away from the wire 11 that extend horizontally in the X-axis direction between the pair of drag pulleys 41*a* and 41*b* and the reel-side pulley 42.

Figure 1:
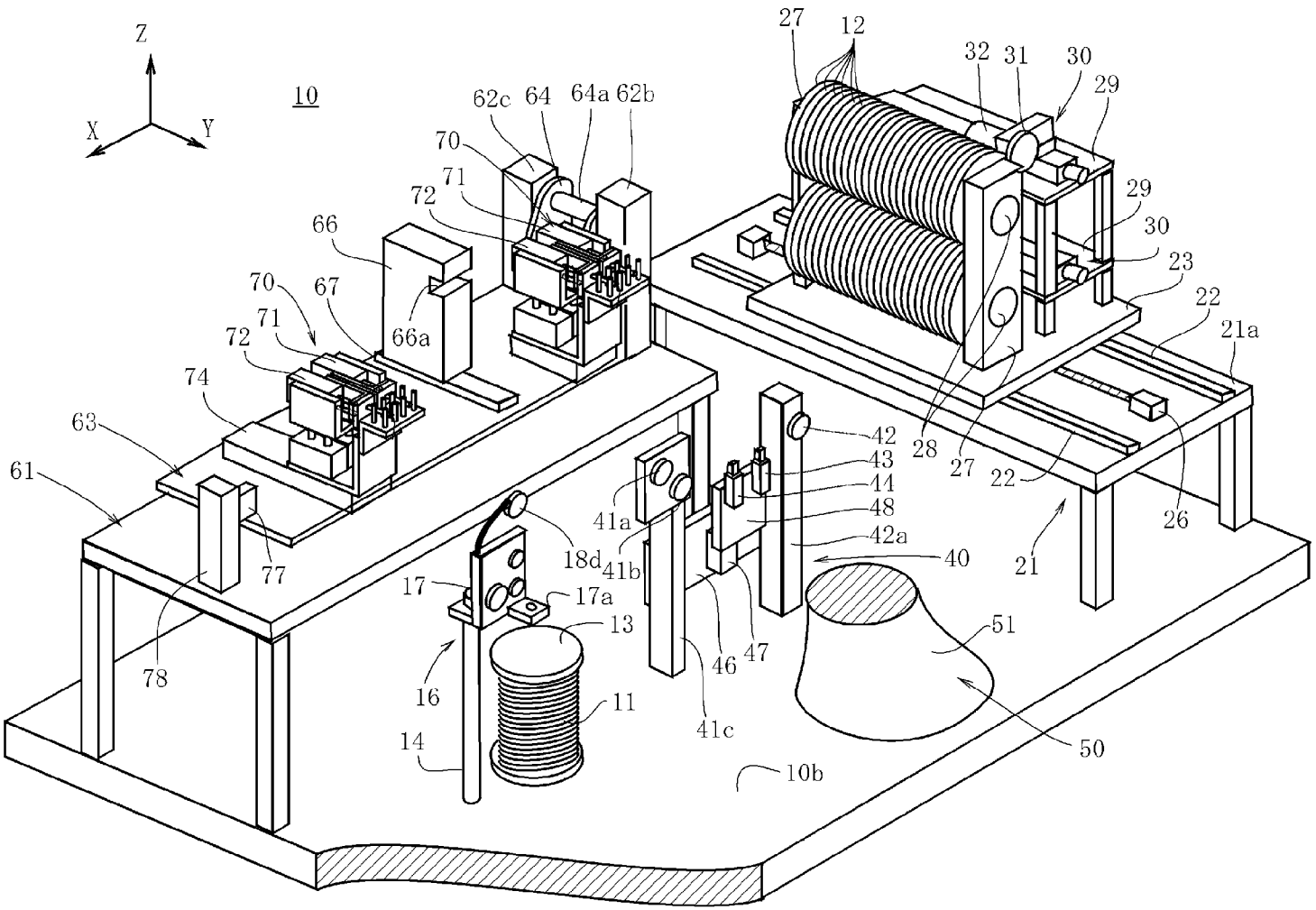
FIG. 1 is a perspective view of a wire bundling device according to an embodiment of the present invention in which conveying means is excluded.
Figure 2:
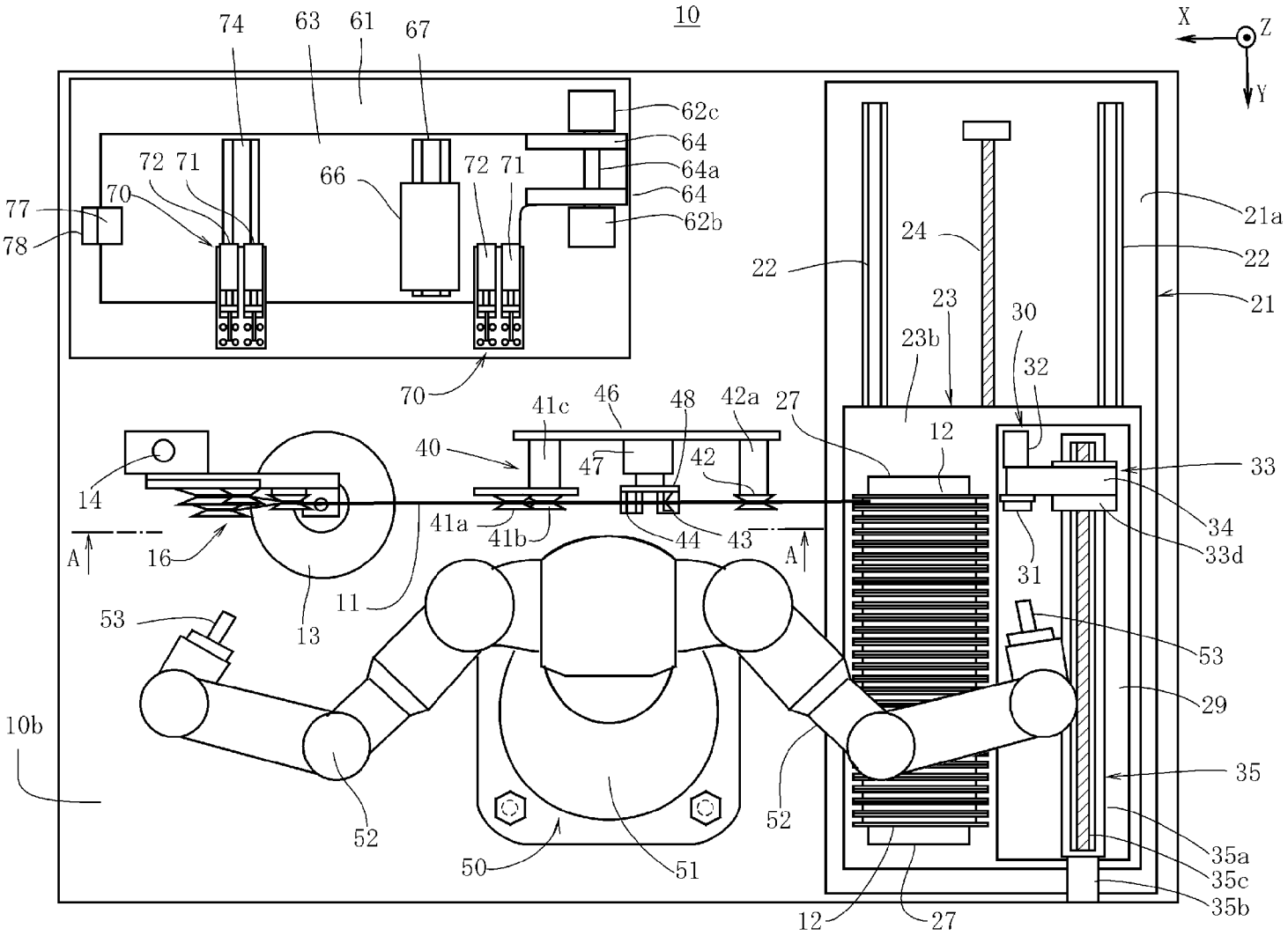
FIG. 2 is a top view illustrating a state where a wire is wound around a first reel by the wire bundling device.

As illustrated in FIGS. 2 to 4, the wire bundling device 10 of the present invention includes wire first-end conveying means 50 that moves the first end of the wire 11 grasped by the cutting and grasping device 40 from the cutting and grasping device 40 so as to be caught at the reel 12. The conveying means 50 of this embodiment is a so-called industrial robot that includes a body portion 51 fixed to the base 10*b* and two free arms 52 that are provided to the body portion 51 at both sides in the X-axis direction and move along a predetermined trajectory. The body portion 51 is formed at the first end in the Y-axis direction of the center of the base 10*b* shifted in the Y-axis direction from the cutting and grasping device 40. A pair of grasping pieces 53 capable of grasping the wire 11 is formed at the distal ends of the free arms 52 of the conveying means 50. The pair of grasping pieces 53 grasps the wire 11 arranged horizontally between the nipper device 43 and the clamp device 44. After that, the free arm 52 moves along the predetermined trajectory to guide the first end of the wire 11 to one of the plurality of reels 12. The first end of the wire 11 is inserted into the catching groove 12*c* formed in the reel 12 as indicated by a broken-line arrow in FIG. 6. In this way, the conveying means 50 causes the first end of the wire 11 to be caught at the reel 12.

As illustrated in FIGS. 1 to 4, 7 and 8, the wire bundling device 10 of the present invention includes withdrawing means for withdrawing the plurality of wires 11 wound around the plurality of reels 12 from the first end side thereof in a state where the wires 11 are collected from the second end side. Here, a second table 61 is provided at the second end in the Y-axis direction of the base 10*b* shifted in the Y-axis direction from the cutting and grasping device 40, and two brace members 62*b* and 62*c* are formed on an end portion of the second table 61 closer to the plurality of reels 12 at a predetermined gap interposed in the Y-axis direction. The withdrawing means will be described later.

A base plate 63 is attached to the first brace member 62*b* and the second brace member 62*c* that is distant from the cutting and grasping device 40 with an attachment member 64 interposed. The base plate 63 is formed in parallel to a top surface of the second table 61 (see FIG. 8), and a pair of attachment members 64 is formed on a side of the base plate 63 closer to the plurality of reels 12 with a predetermined gap interposed in the Y-axis direction. An attachment pipe 64*a* that extends in the Y-axis direction is formed between the upper portions of the attachment members 64, and insertion members 65 that are inserted to both ends of the attachment pipe 64*a* are formed in the first and second brace members 62*b* and 62*c*, respectively. Moreover, an end portion of the base plate 63 distant from the plurality of reels 12 is attached to an attachment piece 77 that maintains the base plate 63 horizontally, and the attachment piece 77 is provided in a supporting piece 78 that is formed on the second table 61 (see FIG. 8).

Figure 7:
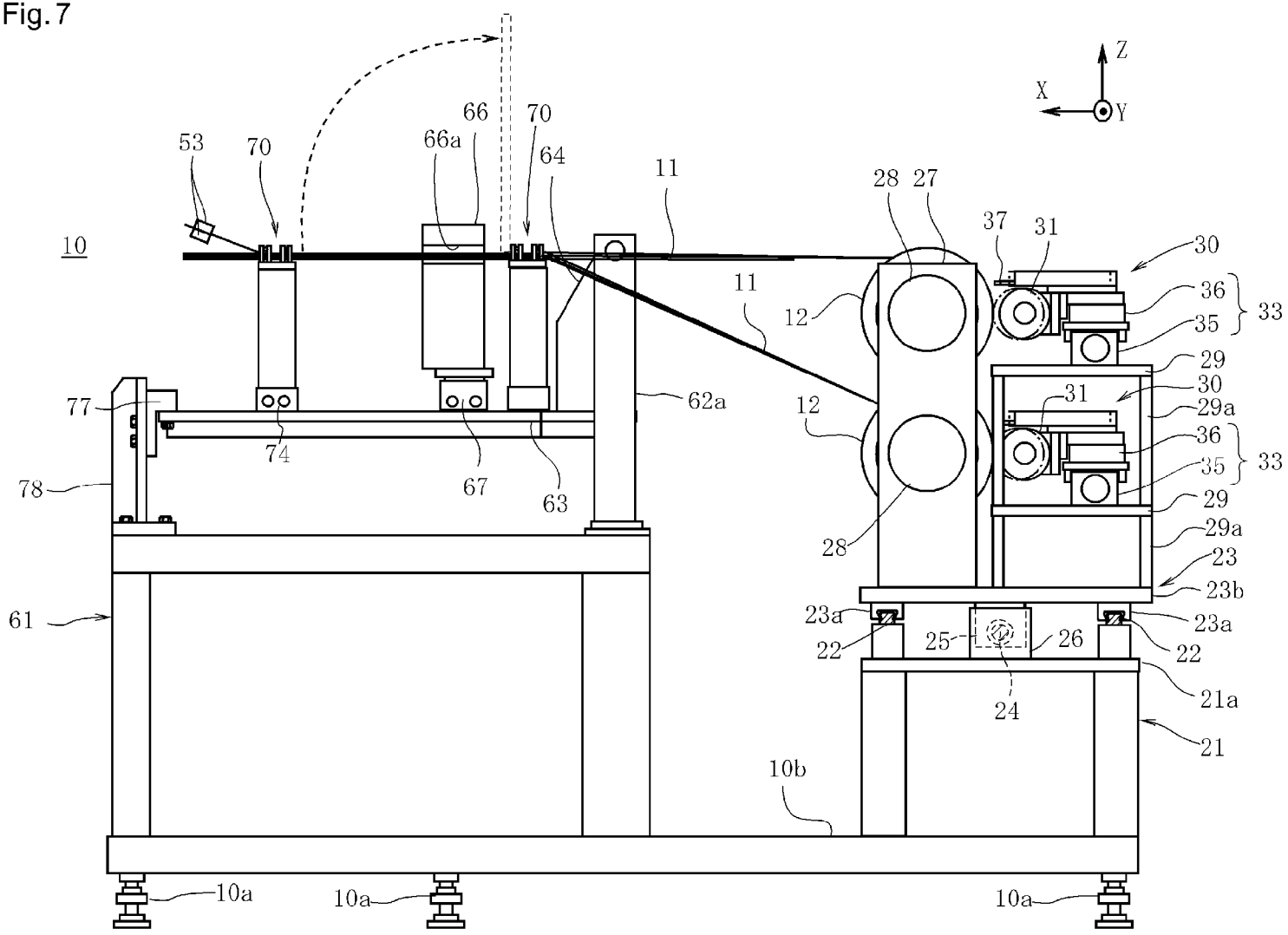
FIG. 7 is an enlarged view along line B-B of FIG. 3.

As illustrated in FIG. 7, wire second-end pressing means 70 for collecting and pressing the respective second ends of the plurality of wires 11 fed from the single spool 13 is formed on the base plate 63. A pair of wire second-end pressing means 70 is formed on the base plate 63 with a predetermined gap interposed in the X-axis direction. Since these wire second-end pressing means 70 have the same structure, the wire second-end pressing means 70 on the downstream side distant from the spool 13 will be described as a representative example. As illustrated in detail in FIGS. 10 and 11, the wire second-end pressing means 70 includes first pressing means 71 for releasably pressing the wire 11 and second pressing means 72 provided adjacent to the first pressing means 71, for pressing the wire 11 when the wire 11 is released by the first pressing means 71. These pressing means have the same structure and each include mounting bases 71*a* and 72*a* on which the wire 11 having passed through the wire second-end pressing means 70 on the upstream side close to the spool 13 is mounted, a plurality of pins 71*b* and 72*b* which is formed on the mounting bases 71*a* and 72*a* so as to interpose the wire 11 from both sides in the Y-axis direction and restricts the movement of the wire 11 in the Y-axis direction, pressing members 71*c* and 72*c* that press the wire 11 inserted between the pins 71*b* and 72*b* from the upper side, Y axis direction cylinders 71*d* and 72*d* that move the pressing members 71*c* and 72*c* in the Y-axis direction, and lifting cylinders 71*e* and 72*e* that move the pressing members 71*c* and 72*c* up and down in the Z-axis direction together with the Y axis direction cylinders 71*d* and 72*d*.

The Y axis direction cylinders 71*d* and 72*d* are air cylinders that cause rods 71*f* and 72*f* to protrude in the Y-axis direction according to the supply of compressed air, and the pressing members 71*c* and 72*c* are attached to the distal ends of the rods 71*f* and 72*f* with attachment plates 71*h* and 72*h* interposed. On the other hand, the lifting cylinders 71*e* and 72*e* are air cylinders that cause rods 71*g* and 72*g* to protrude upward in the Z-axis direction according to the supply of compressed air, and the Y axis direction cylinders 71*d* and 72*d* are attached to the upper ends of the rods 71*g* and 72*g* with attachment members 71*j* and 72*j* interposed.

Figure 12:
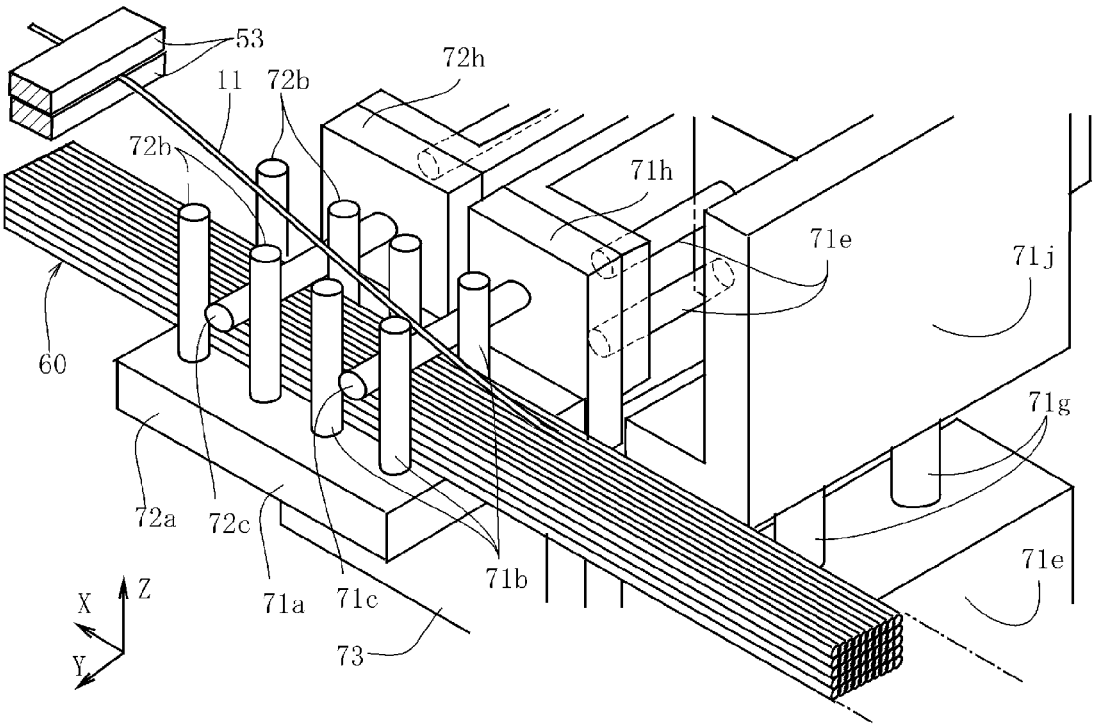
FIG. 12 is a perspective view illustrating a state where a second end of a wire is guided to the wire second-end pressing means.
Figure 13:
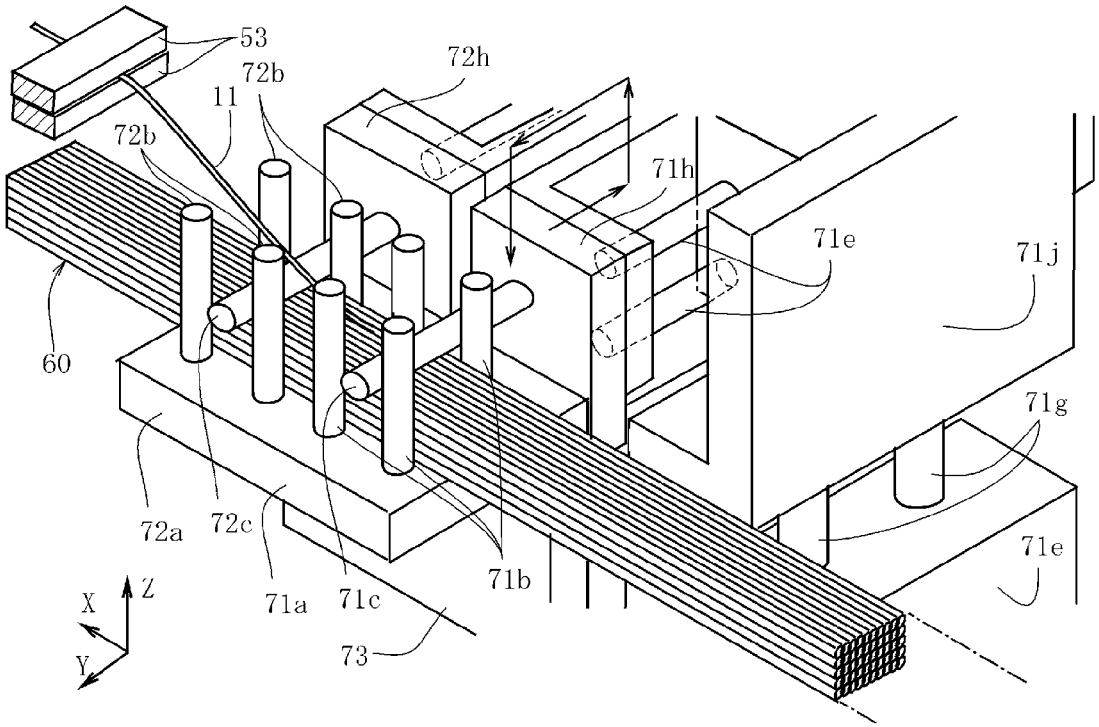
FIG. 13 is a perspective view corresponding to FIG. 12, illustrating a state where the second end of the wire is pressed by first pressing means of the wire second-end pressing means.
Figure 14:
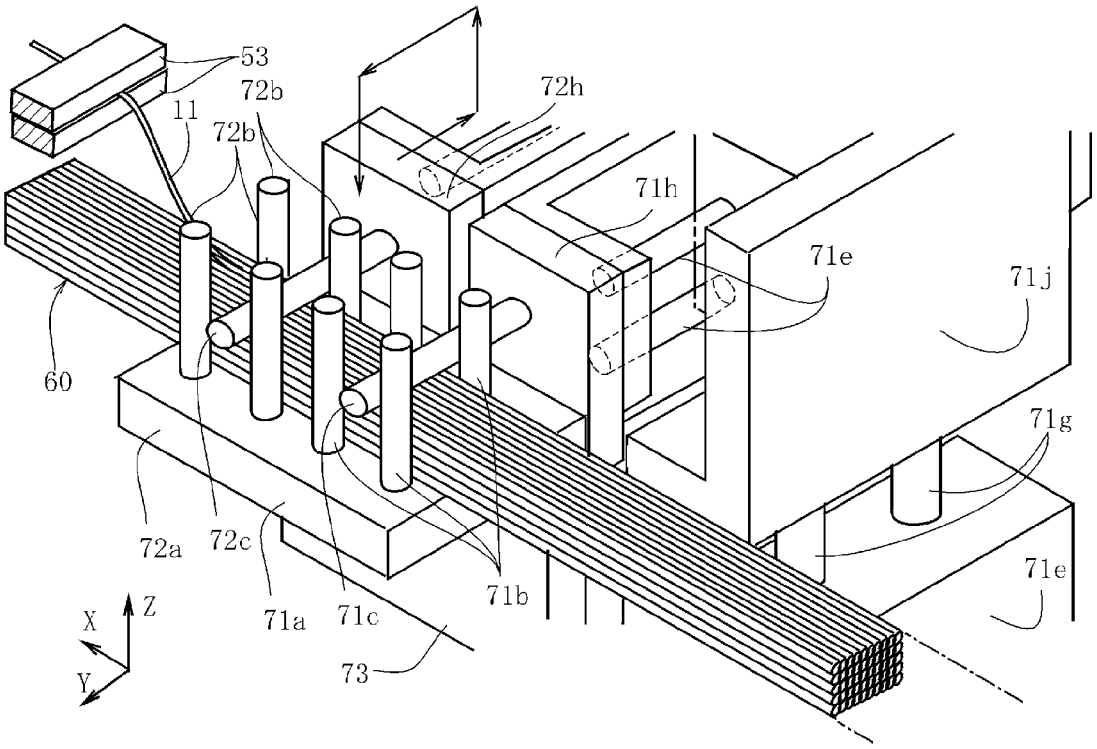
FIG. 14 is a perspective view corresponding to FIG. 12, illustrating a state where the second end of the wire is further pressed by second pressing means of the wire second-end pressing means.

In the first and second pressing means 71 and 72 having such a configuration, the pressing members 71*c* and 72*c* are moved in the Y-axis direction by the Y axis direction cylinders 71*d* and 72*d* so as to be shifted from between the pins 71*b* and 72*b*. In this state, the pressing members 71*c* and 72*d* are moved upward by the lifting cylinders 71*e* and 72*e* together with the Y axis direction cylinders 71*d* and 72*d*. The pressing members 71*c* and 72*c* are returned to be between the pins 71*b* and 72*b* by the Y axis direction cylinders 71*d* and 72*d*. After that, the pressing members 71*c* and 72*c* are moved downward by the lifting cylinders 71*e* and 72*e*. In this way, the pressing members 71*c* and 72*c* can be moved approximately in a rectangular form as indicated by a solid-line arrow in FIG. 11. When the pressing members 71*c* and 72*c* are moved in this manner, the wire 11 that is guided to be positioned between the plurality of pins 71*b* and 72*b* and mounted on the mounting bases 71*a* and 72*a* can be pressed by the pressing members 71*c* and 72*c*. Thus, as illustrated in FIGS. 12 to 14, when the first and second pressing means 71 and 72 alternately press the wire 11, the second pressing means can reliably press the wire 11 when the first pressing means releases the wire 11.

The first and second pressing means 71 and 72 of the downstream-side wire second-end pressing means 70 on the downstream side are formed on a movable mount 73 so as to be arranged in the X-axis direction, and a cylinder 74 that moves the first and second pressing means 71 and 72 in the Y-axis direction together with the movable mount 73 is provided on the base plate 63. The cylinder 74 is an air cylinder that moves the movable mount 73 in the Y-axis direction according to the supply of compressed air. As illustrated in FIG. 3, the cylinder 74 is configured to allow the movable mount 73 to reciprocate together with the downstream-side wire second-end pressing means 70 between a first position where the wire 11 having passed through the upstream-side wire second-end pressing means 70 is mounted on the mounting bases 71*a* and 72*a* and a second position where the mounting bases 71*a* and 72*a* are shifted in the Y-axis direction without being positioned at the same position in the X-axis direction of the upstream-side wire second-end pressing means 70 as shown in FIG. 4.

Figure 8:
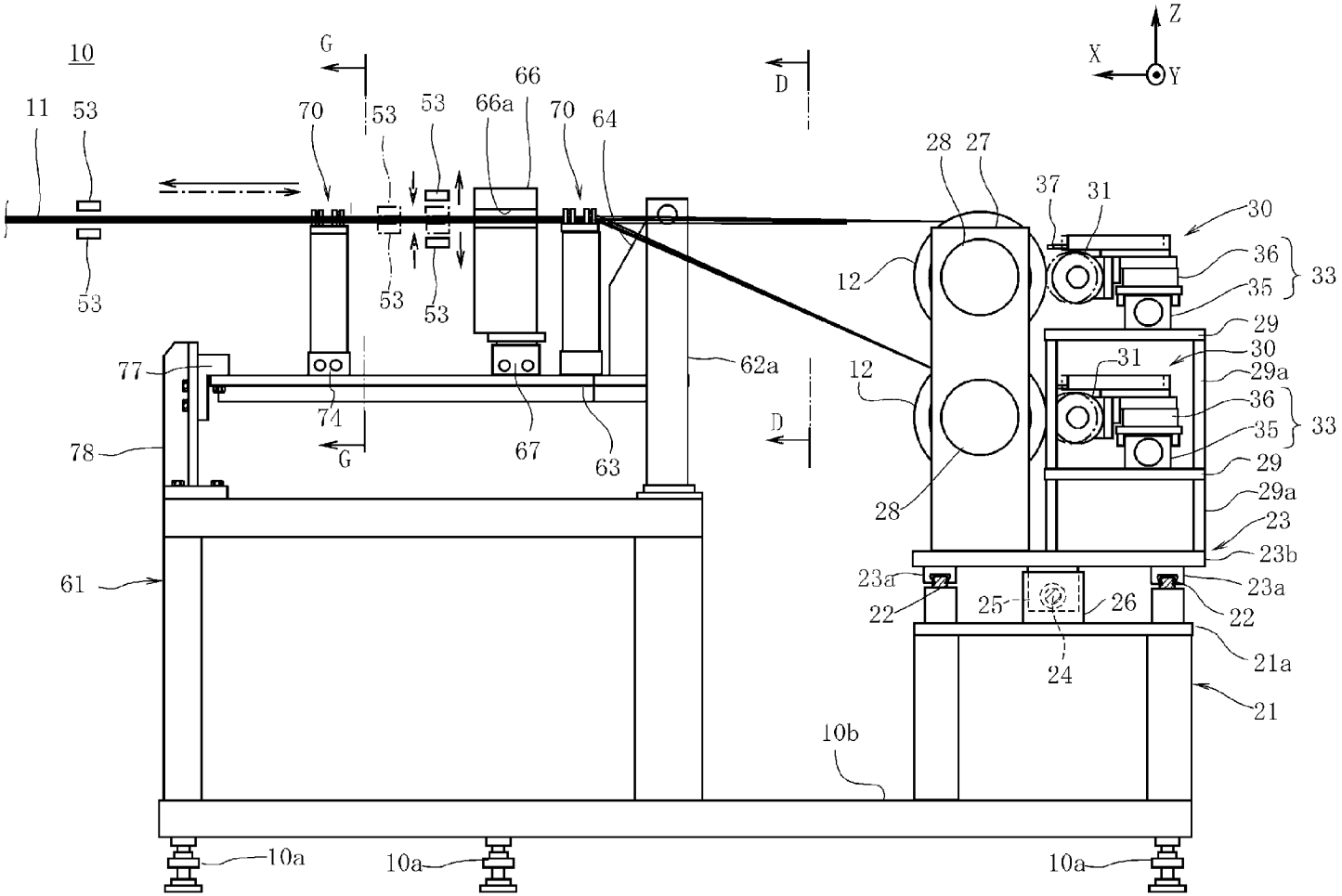
FIG. 8 is an enlarged view along line C-C of FIG. 4.
Figure 9:
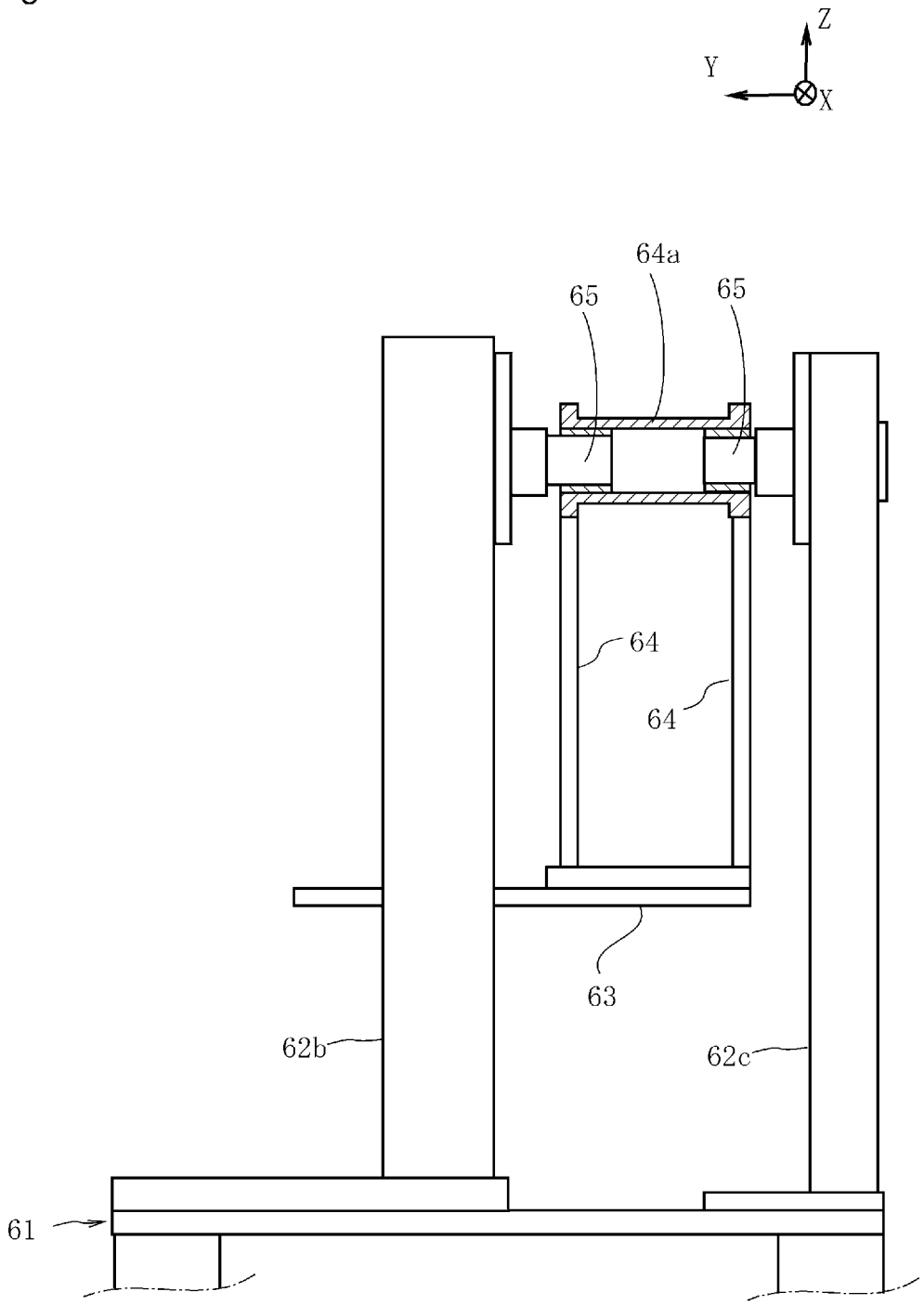
FIG. 9 is an enlarged view along line D-D of FIG. 8.
Figure 10:
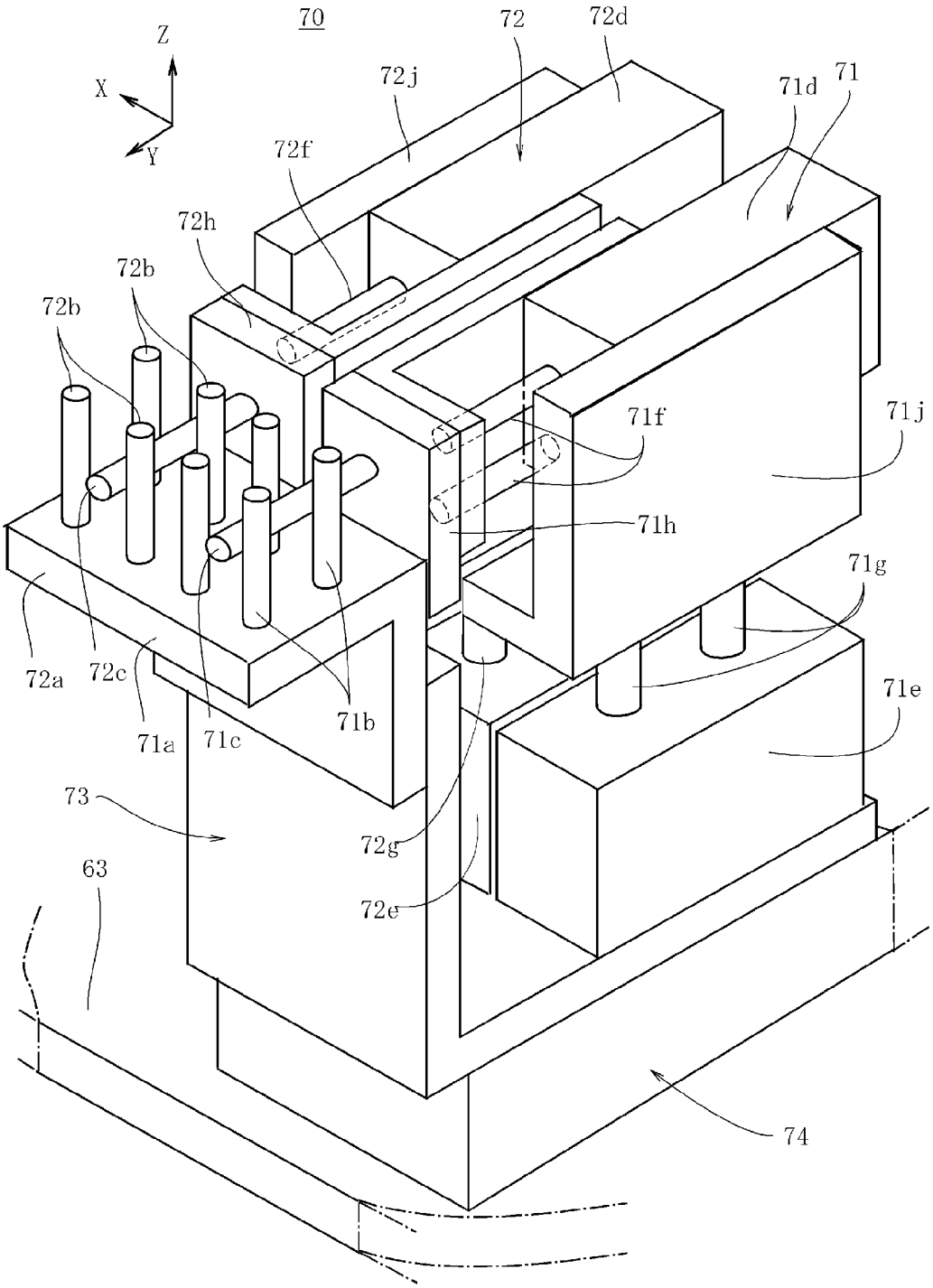
FIG. 10 is a perspective view illustrating wire second-end pressing means.
Figure 11:
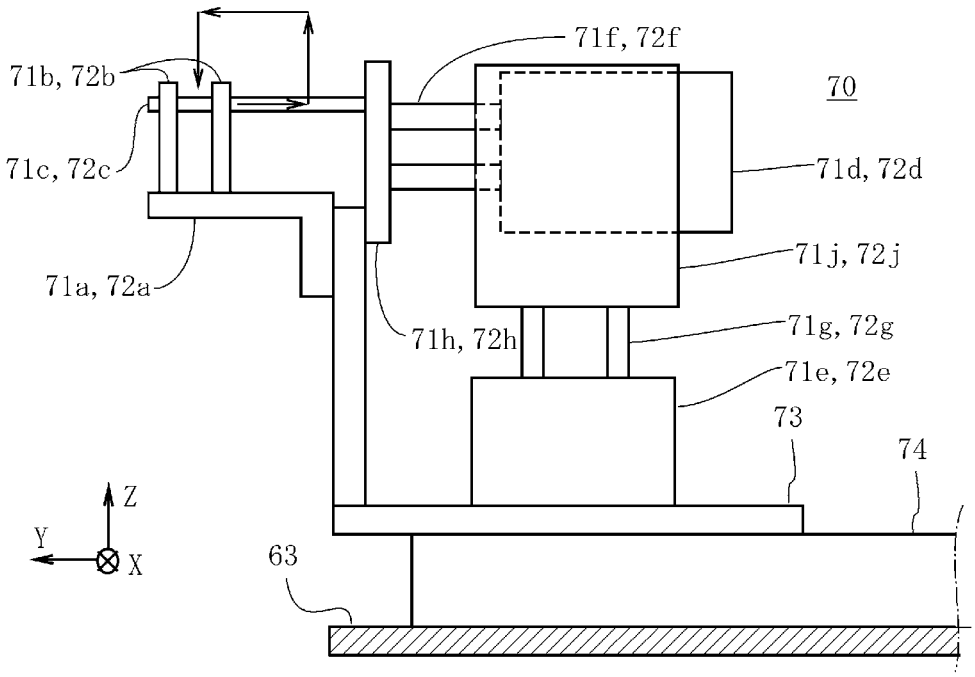
FIG. 11 is an enlarged view along line G-G of FIG. 8.

Moreover, an existing taping device 66 is formed on the base plate 63 between the upstream-side wire second-end pressing means 70 and the downstream-side wire second-end pressing means 70 with a cylinder 67 interposed. The cylinder 67 is an air cylinder that moves the taping device 66 in the Y-axis direction according to the supply of compressed air. The cylinder 67 is configured to allow the taping device 66 to reciprocate between a first position where the plurality of wires 11 is inserted into an insertion groove 66*a* as illustrated in FIGS. 4 and 8 and a second position where the plurality of wires 11 is withdrawn from the insertion groove 66*a* as shown in FIGS. 2, 3 and 7.

The wire bundling device 10 includes wire second-end conveying means for guiding the second end of the wire 11 wound around one reel 12 by a predetermined length to wire second-end pressing means 70, the second end being an end portion of the cut wire 11 when the wire wound around one reel 12 by a predetermined length is cut by the cutting and grasping device 40. The wire second-end conveying means is realized also by a so-called industrial robot which is the wire first-end conveying means 50 described above. The wire second-end conveying means is configured such that the pair of grasping pieces 53 at the distal end of the free arm 52 of the conveying means 50 grasps the end portion of the wire 11 between the nipper device 43 and the reel 12 disposed closer to the nipper device 43, the free arm 52 moves along the predetermined trajectory, and the second end of the wire 11 closer to the reel 12, cut by the nipper device 43 is guided to the wire second-end pressing means 70 by the wire second-end conveying means.

Next, a wire bundling method according to the present invention using the wire bundling device 10 will be described. It is assumed that the operation of the wire bundling device 10 is automatically controlled by a controller (not illustrated) mounted on the wire bundling device 10. The wire bundling method of the present invention includes a wire winding step of winding a predetermined length of wire 11 fed from the single spool 13 around the reel 12, cutting the wire 11, and repeating the winding and cutting so that the predetermined length of wire 11 is wound around each of the plurality of reels 12, and a withdrawing step of bundling the plurality of wires 11 having the predetermined length wound separately around the plurality of reels 12 and withdrawing the plurality of wires 11 from the plurality of reels 12. In this embodiment, it is assumed that a stretching step of stretching the respective wires 11 withdrawn from the plurality of reels 12 is performed between the wire winding step and the withdrawing step. Each step will be described below as follows.

In the wire winding step, an operation of winding the predetermined length of wire 11 fed from the single spool 13 around the reel 12 and cutting the wire 11 is repeatedly performed. Thus, as illustrated in FIG. 5, as a preparation for starting the wire winding step, the spool 13 around which the wire 11 is wound is prepared, and the spool 13 is mounted on the base 10*b*. Moreover, an end portion of the wire 11 unwound from the spool 13 is grasped by the clamp device 44 of the cutting and grasping device 40 with the aid of the tension device 16. Moreover, the motor 26 is driven to rotate the conveying screw shaft 24 to move the movable mount 23 on which the plurality of reels 12 is provided in the Y-axis direction so that as illustrated in FIG. 2, the reel 12 positioned at the end in the Y-axis direction of the movable mount 23, that is one of the reels 12 furthest from the conveying means 50 is moved in the X-axis direction of the clamp device 44. Concurrently, the electric motor 32 is moved in the Y-axis direction by the motor moving means 33 of the rotating means 30 with the mount 34 interposed, and the contact roller 31 provided in the rotating shaft of the electric motor 32 faces the outer circumference of the one reel 12.

Figure 6:
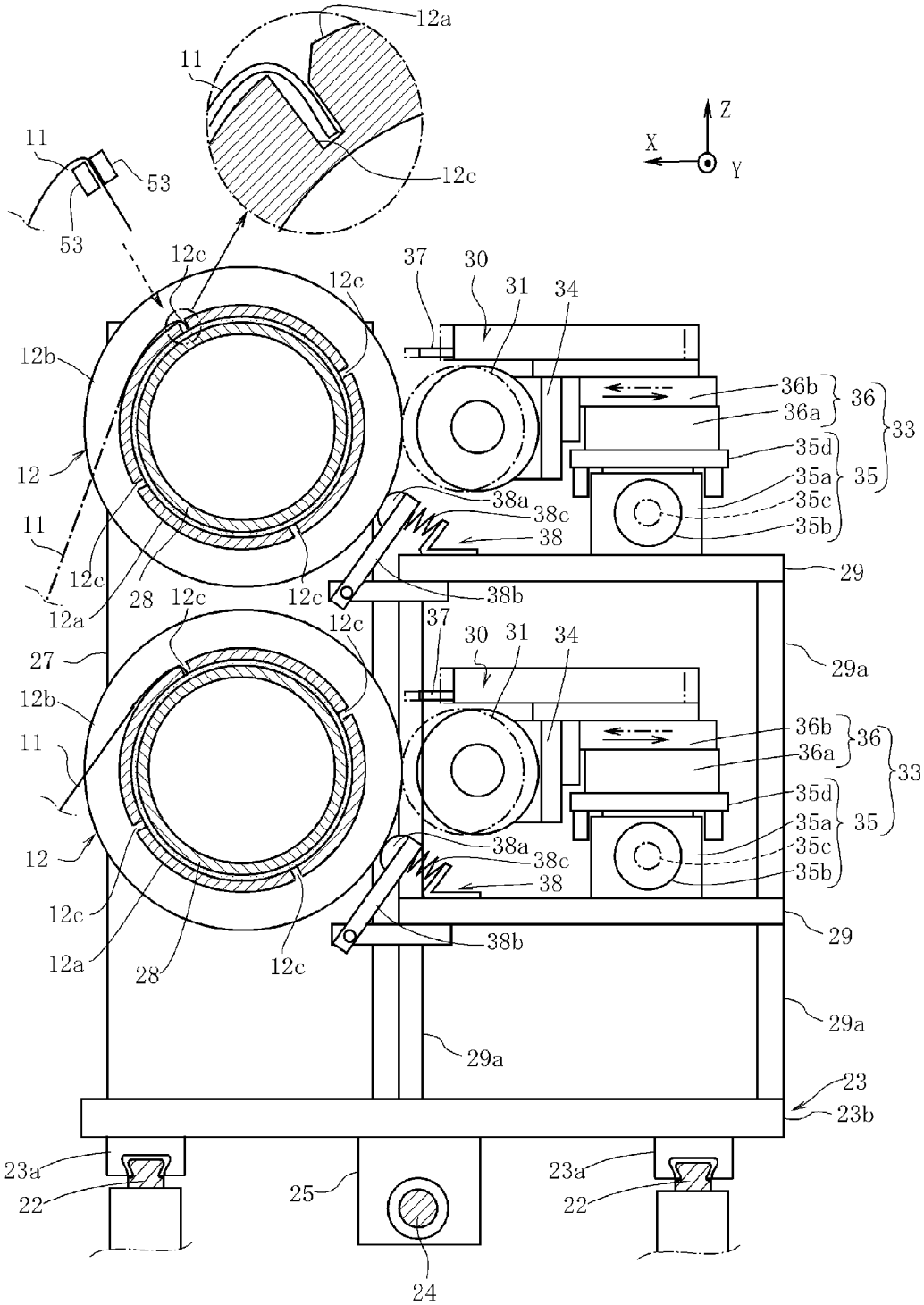
FIG. 6 is an enlarged view of rotating means.

After that, the cylinder 36 (illustrated in FIG. 6) of the rotating means 30 moves the mount 34 toward the one reel 12 as indicated by a one-dot chain-line arrow so that the contact roller 31 makes contact with the outer circumference of the one reel 12. Moreover, the electric motor 32 is driven to rotate the reel 12 that is in contact with the contact roller 31, and the rotation is stopped in a state where the catching groove 12*c* formed in the reel 12 is positioned at a predetermined position (in this embodiment, as illustrated in FIG. 6), the catching groove 12*c* is positioned obliquely upward of the robot. The position of the catching groove 12*c* is detected by the sensor 37. In this state, the wire winding step starts.

In the wire winding step, first, the wire 11 arranged horizontally between the nipper device 43 and the clamp device 44 is grasped by the pair of grasping pieces 53 of the wire first-end conveying means 50. After that, the grasping of the wire by the clamp device 44 is released, and the auxiliary plate 48 is moved down as indicated by a one-dot chain-line arrow in FIG. 5 so that the nipper device 43 and the clamp device 44 are moved away from the wire 11. The free arm 52 is moved so that the first end of the wire grasped by the pair of grasping pieces 53 is dragged and the wire 11 is latched around the reel-side pulley 42. After that, the first end of the wire 11 is guided to one reel 12 that is positioned in the X-axis direction of the clamp device 44. In this embodiment, it is assumed that the wire 11 is first guided to the uppermost reel 12. Moreover, as indicated by a broken-line arrow in FIG. 6, the first end of the wire 11 is inserted into the catching groove 12*c* formed in the reel 12 so that the first end of the wire 11 is caught at the reel 12.

After that, the grasping of the first end of the wire by the pair of grasping pieces 53 of the conveying means 50 is released, and the electric motor 32 is driven to rotate the reel 12 that is in contact with the contact roller 31 so that a predetermined length of wire 11 fed from the single spool 13 is wound around the reel 12. The predetermined length of the wire 11 is measured based on the number of rotations of the reel 12. The reel 12 is rotated by a predetermined number of times, and when a predetermined length of wire 11 is wound around the reel 12, the rotation of the reel 12 is stopped.

After that, as illustrated in FIG. 5, the auxiliary plate 48 that has been moved down is lifted as indicated by a solid-line arrow. The wire 11 that extends horizontally in the X-axis direction between the pair of drag pulleys 41*a* and 41*b* and the reel-side pulley 42 is grasped again by the clamp device 44, and the wire 11 disposed between the reel-side pulley 42 and the reel 12 and near the reel-side pulley 42 is grasped by the pair of grasping pieces 53 of the conveying means 50. In this state, the wire 11 disposed between the clamp device 44 and the reel-side pulley 42 is cut by the nipper device 43. Although an end portion of the wire 11 is formed at the cut point by the cutting, the clamp device 44 grasps the first end of the wire 11 formed by the cutting as the first end of the wire 11 fed from the spool 13 and grasps the second end of the cut wire 11, which is grasped by the pair of grasping pieces 53 of the conveying means 50 as the second end of the wire 11 which is wound around one reel 12 by a predetermined length.

After that, the wire second-end conveying means 50 guides the second end of the wire 11 which is wound around the one reel 12 by a predetermined length and grasped by the pair of grasping pieces 53 to the downstream-side wire second-end pressing means 70 via the upstream-side wire second-end pressing means 70. In this case, the cylinder 67 that supports the taping device 66 separates the taping device 66 from the wire 11 that is guided by the conveying means 50 that serves also as the wire second-end conveying means using the taping device 66 as a second position (see FIG. 3).

First, as described above, the wire second-end conveying means 50 guides the upstream-side wire second-end pressing means 70 and further guides the second end of the wire 11 having passed through the upstream-side wire second-end pressing means 70 to the downstream-side wire second-end pressing means 70. Here, as illustrated in FIG. 3, the downstream-side wire second-end pressing means 70 is moved to a first position where the wire 11 having passed through the upstream-side wire second-end pressing means 70 is mounted on the mounting bases 71*a* and 72*a* by the cylinder 74. Although the second end of the wire 11 is pressed by the upstream-side wire second-end pressing means 70 and the downstream-side wire second-end pressing means 70, since the wire pressing operations of the upstream-side and downstream-side wire second-end pressing means 70 are the same, the wire pressing operation of the downstream-side wire second-end pressing means 70 will be described as a representative example.

As illustrated in FIG. 12, the conveying means 50 conveys the wire 11 which has been grasped and guided by the pair of grasping pieces 53 to be placed on the mounting bases 71*a* and 72*a* between the plurality of pins 71*b* and 72*b*. The first pressing means 71 of the wire second-end pressing means 70 closer to the reel 12 is first driven so that as indicated by a solid-line arrow in FIG. 13, the pressing member 71*c* is moved approximately in a rectangular form. In this way, the wire 11 which has been guided between the plurality of pins 71*b* and mounted on the mounting base 71*a* is pressed by the pressing member 71*c*. After that, the second pressing means 72 of the wire second-end pressing means 70 is driven subsequently so that as indicated by a solid-line arrow in FIG. 14, the pressing member 72*c* is moved approximately in a rectangular form. In this way, the wire 11 which has been guided between the plurality of pins 72*b* and mounted on the mounting base 72*a* is pressed by the pressing member 72*c*.

In this manner, the predetermined length of wire 11 fed from the single spool 13 is wound around the first one reel 21, the wire 11 is cut, the second end of the wire 11 wound around the reel 12 is pressed by the pair of wire second-end pressing means 70. However, the order of pressing is such that the second end of the wire 11 is first pressed by the upstream-side wire second-end pressing means 70 and is then pressed by the downstream-side wire second-end pressing means 70. That is, the wire 11 which has been mounted on the mounting base 72*a* of the upstream-side wire second-end pressing means 70 and pressed by the pressing member 72*c* is movable in the longitudinal direction thereof. Thus, after the wire 11 is pressed by the upstream-side wire second-end pressing means 70, the conveying means 50 guides the wire 11 which has been guided to the upstream-side wire second-end pressing means 70 by being grasped by the pair of grasping pieces 53 further to the downstream-side wire second-end pressing means 70 while withdrawing the wire 11 from the upstream-side wire second-end pressing means 70. The wire 11 is pressed again by the downstream-side wire second-end pressing means 70.

Next, a predetermined length of wire 11 is wound around a reel 12 on the downstream side of the reel 12 around which the wire 11 is first wound. Specifically, the wire 11 that is arranged horizontally between the nipper device 43 and the clamp device 44 is grasped by the pair of grasping pieces 53 of the conveying means 50, the first end of the wire 11 is inserted into the catching groove 12*c* formed in the lower reel 12, and the first end of the wire 11 is caught at the reel 12. A subsequent operation of winding the wire 11 around the lower reel 12 is the same as the operation of winding the wire 11 around the upper reel 12. The wire second-end conveying means 50 guides the second end of the wire 11, which is wound around the lower reel 12 by a predetermined length, to the pair of wire second-end pressing means 70 by the same procedure as the wire 11 wound around the upper reel 12, and the second end of the wire 11 wound around the lower reel 12 is pressed by the pair of wire second-end pressing means 70.

Subsequently, a predetermined length of wire 11 is wound around the next reel 12 adjacent to the first one reel 12 on the upper side. That is, the movable mount 23 on which the plurality of reels 12 is provided is moved again in the Y-axis direction, and the next reel 12 adjacent to the first one reel 12 is positioned in the X-axis direction of the clamp device 44. Concurrently, the contact roller 31 provided in the rotating shaft of the electric motor 32 faces the outer circumference of the next reel 12, and the contact roller 31 is brought into contact with the outer circumference of the next reel 12 by the cylinder 36. Moreover, the next reel 12 is rotated so that the catching groove 12*c* formed in the next reel 12 stops at a predetermined position.

Subsequently, the wire 11 that is arranged horizontally between the nipper device 43 and the clamp device 44 is grasped by the pair of grasping pieces 53 of the conveying means 50, the first end of the wire 11 is inserted into the catching groove 12*c* formed in the next reel 12, and the first end of the wire 11 is caught at the next reel 12. The operation of winding the wire 11 around the next reel 12 is the same as the operation of winding the wire around the first one reel 12. The wire second-end conveying means 50 guides the second end of the wire 11 which is wound around the next reel 12 by a predetermined length to the pair of wire second-end pressing means 70 by the same procedure as the wire 11 wound around the first one reel 12, and the second end of the wire 11 wound around the next reel 12 is pressed by the pair of wire second-end pressing means 70.

Such an operation is repeatedly performed, a predetermined length of wire 11 is alternately wound around the plurality of reels 12 which is supported by the two supporting shafts 28 that are provided so as to be arranged vertically with a predetermined gap in the Z-axis direction. In this embodiment, although the wire 11 is wound starting with the upper reel 12, the wire 11 may be wound starting with the lower reel 12.

Here, as illustrated in FIG. 12, whenever a predetermined length of wire 11 is wound around each reel 12, the wire second-end conveying means 50 guides the second end of the wire 11 wound around each reel 12 to the pair of wire second-end pressing means 70. Moreover, in the pair of wire second-end pressing means 70, the first pressing means 71 of each wire second-end pressing means 70 closer to the reel 12 is first driven so that as indicated by a solid-line arrow in FIG. 13, the pressing member 71*c* is moved approximately in a rectangular form. In this way, the wire 11 which has been guided between the plurality of pins 71*b* and mounted on the mounting base 71*a* is pressed by the pressing member 71*c*. After that, the second pressing means 72 of each wire second-end pressing means 70 is driven subsequently so that as indicated by a solid-line arrow in FIG. 14, the pressing member 72*c* is moved approximately in a rectangular form. In this way, the wire 11 which has been guided between the plurality of pins 72*b* and mounted on the mounting base 72*a* is pressed by the pressing member 72*c*.

In this manner, whenever the wire 11 is wound around the reel 12 in the wire winding step, the second ends of the wires 11 wound around the plurality of reels 12 are collected and pressed. The pressing of the second end of the wire 11 is performed by the first pressing means 71 that releasably presses the wire 11 and the second pressing means 72 that is provided adjacent to the first pressing means 71 so as to press the wire 11 when the wire 11 is released at least by the first pressing means 71. Therefore, the pressing of the second end of the wire 11 by the wire second-end pressing means 70 is prevented from being temporarily removed. Thus, it is possible to reliably collect and press the second ends of the wires 11 wound around the plurality of reels 12.

As described above, the operation of winding a predetermined length of wire 11 fed from the single spool 13 around the reel 12 and cutting the wire 11 is repeatedly performed so that a predetermined length of wire 11 is wound around each of a necessary number of reels 12, and all of the second ends of the wires 11 wound around the plurality of reels 12 are collected and pressed by the pair of wire second-end pressing means 70. In this state, the wire winding step ends. As illustrated in FIG. 3, at the end of the wire winding step, the movable mount 23 on which the plurality of reels 12 is provided is moved to a position such that a central portion in the Y-axis direction of the plurality of reels 12 faces the pair of wire second-end pressing means 70 that is present in the X-axis direction thereof.

In the subsequent stretching step, the respective wires 11 which have been withdrawn from the plurality of reels 12 and have passed through the upstream-side wire second-end pressing means 70 are stretched. In this stretching step, first, the pressing members 71*c* and 72*c* are moved in the Y-axis direction so as to be shifted by the Y axis direction cylinders 71*d* and 72*d* of the downstream-side wire second-end pressing means 70, and the upper portions of the plurality of wires 11 which is disposed between the pins 71*b* and 72*b* and pressed by the pressing members 71*c* and 72*c* are released (see FIG. 10). As indicated by a broken line in FIG. 7, the end portions of the plurality of wires 11 that protrudes from the upstream-side wire second-end pressing means 70 are bent upward by the conveying means 50, and the plurality of wires 11 is caught by the upstream-side wire second-end pressing means 70 so as to prevent the plurality of wires 11 from moving toward the reel 12. Moreover, the rotating means 30 sequentially rotates the plurality of reels 12 in the direction of winding the wire 11, and the respective wires 11 which have been withdrawn from the plurality of reels 12 and passed through the upstream-side wire second-end pressing means 70 are sequentially stretched.

In this manner, by stretching the respective wires 11 having passed through the upstream-side wire second-end pressing means 70, it is possible to prevent some of the plurality of wires 11 from being bent in the subsequent withdrawing step. In this stretching step, the cylinder 74 of the downstream-side wire second-end pressing means 70 moves the downstream-side wire second-end pressing means 70 to a second position where the downstream-side wire second-end pressing means 70 is separated from the plurality of wires 11 in the Y-axis direction.

In the subsequent withdrawing step, the plurality of wires 11 having the predetermined length wound separately around the plurality of reels 12 is withdrawn from the plurality of reels 12 in a state where the wires 11 are collected and bundled at the second end side. Withdrawing of the plurality of wires 11 is specifically performed by the withdrawing means 50. In this embodiment, a case where the withdrawing means 50 is realized by a so-called industrial robot that serves both as the wire first-end conveying means 50 and the wire second-end conveying means 50 is illustrated. That is, the pair of the grasping pieces 53 at the distal end of one free arm 52 of the robot 50 which serves as the conveying means 50 and the withdrawing means concurrently grasps all of the plurality of wires 11 which is bent upward and caught at the upstream-side wire second-end pressing means 70, the free arm 52 moves along the predetermined trajectory, and all of the plurality of wires 11 is concurrently moved in a direction away from the reel 12. In this way, the plurality of wires 11 having the predetermined length wound separately around the plurality of reels 12 are withdrawn from the plurality of reels 12 in a state where the wires 11 are collected by the upstream-side wire second-end pressing means 70.

On the other hand, after the first free arm 52 that has withdrawn the plurality of wires 11 is displaced by a predetermined distance from the upstream-side wire second-end pressing means 70, the movement of the first free arm 52 is stopped temporarily, and as indicated by a one-dot chain line in FIG. 8, the pair of grasping pieces 53 at the distal end of the second free arm 52 grasps all of the plurality of wires 11 near the upstream-side wire second-end pressing means 70. Moreover, the grasping of the wires 11 by the pair of grasping pieces 53 at the distal end of the first free arm 52 is removed, and the pair of the grasping pieces 53 at the distal end is moved to approach near the plurality of wires 11 that is grasped by the pair of grasping pieces 53 of the second free arm 52 as indicated by a one-dot chain-line arrow. After that, all of the plurality of wires 11 is grasped again by the pair of grasping pieces 53 at the distal end of the first free arm 52. The grasping of the plurality of wires 11 by the pair of grasping pieces 53 of the second free arm 52 is removed as indicated by a solid line, and the pair of grasping pieces 53 at the distal end of the first free arm 52 is moved again in a direction away from the upstream-side wire second-end pressing means 70 as indicated by a solid-line arrow. By repeatedly performing such an operation, it is possible to withdraw the plurality of wires 11 intermittently.

When withdrawing the plurality of wires 11, it is preferable that the lifting cylinders 71*e* and 72*e* of the upstream-side wire second-end pressing means 70 lift the pressing members 71*c* and 72*c* together with the Y axis direction cylinders 71*d* and 72*d* in a state where the pressing members 71*c* and 72*c* are positioned between the pins 71*b* and 72*b*, and the pressing of the wires by the pressing members 71*c* and 72*c* is removed. By doing so, since the pressing members 71*c* and 72*c* are positioned between the pins 71*b* and 72*b*, the plurality of wires 11 may not be moved from between the pins 71*b* and 72*b*, and the plurality of wires 11 can be withdrawn without a resistance.

Moreover, in this withdrawing step, although the wire 11 is intermittently fed from a plurality of pulleys 12, since the contact 38*a* of the inertial rotation preventing device 38 illustrated in FIG. 6 makes contact with the outer circumference of the disk 12*b* of the reel 12 by the biasing force of the spring 38*c* and becomes a resistance to free rotation of the reel 12, the reel 12 is prevented from rotating by inertia when feeding of the wire 11 is stopped, and further feeding of the wire 11 resulting from the inertial rotation of the reel 12 is prevented. Therefore, it is possible to prevent loosening of the wire 11 which may occur if the wire 11 is further fed from the reel 12 when the withdrawing of the wire 11 by the withdrawing means 50 is stopped.

The withdrawing step ends when all of the plurality of wires 11 having the predetermined length wound separately around the plurality of reels 12 is withdrawn from the plurality of reels 12. The wire bundling method of the present invention starts again from the wire winding step if necessary.

In the wire bundling device 10 and the wire bundling method, since the wire 11 is wound around the reel 12 to obtain a plurality of wires 11 having a length corresponding to the length of the wire 11 wound around the reel 12, the wire bundling device 10 does not require a relatively large installation space. Moreover, it is possible to obtain a plurality of wires 11 having a relatively large length that exceeds the size of the installation space of the wire bundling device 10 as long as the wire 11 has a length such that the wire 11 can be wound around the reel 12.

Moreover, in the wire bundling device 10 and the wire bundling method, although the wire 11 is fed from a single spool 13, since the wire 11 is cut after being wound around the reel 12 by a predetermined length, only the wire 11 which is fed from the spool 13 and has a length smaller than the predetermined length is discarded. Thus, it is possible to decrease the amount of wasted wires 11 being used as compared to the related art in which a wire having a length such that the wire may not form a plurality of wires is discarded.

In the above-described embodiment, a case where the single robot 50 that has two free arms 52 serves both as the wire second-end conveying means 50 that guides the second end of the wire 11 that is wound around one reel 12 by a predetermined length to the pair of wire second-end pressing means 70, the wire first-end conveying means 50 that moves the first end of the wire 11 grasped by the cutting and grasping device 40 from the cutting and grasping device 40 so as to be caught at another reel 12, and the withdrawing means that withdraws the plurality of wires 11 from the plurality of reels 12 has been described. However, the conveying means and the withdrawing means are not limited to the robot 50 that has two free arms 52 as long as the conveying means and the withdrawing means can guide the second end of the wire 11 or the first end of the wire 11 or can withdraw the plurality of wires 11 from the plurality of reels 12. The wire second-end conveying means, the wire first-end conveying means, and the withdrawing means may be implemented as a dedicated machine or may be provided separately.

Moreover, in the above-described embodiment, a case where two supporting shafts 28 are provided between the pair of support walls 27 with a predetermined gap interposed in the Z-axis direction, and the plurality of reels 12 is supported by the two supporting shafts 28 has been described. However, the plurality of reels 12 may be supported by a single supporting shaft 28. Moreover, the number of supporting shafts 28 that support the plurality of reels 12 may be three, four, and five or more as long as the passage in the pair of wire second-end pressing means 70 can be implemented. When the plurality of supporting shafts 28 is provided in this manner, since the number of reels 12 that are supported by the supporting shafts 28 increases, it is possible to obtain a larger number of wires 11 having the same length.

The following is a list of reference numerals appearing in the above specification:

10 Wire bundling device
11 Wire
12 Reel
13 Spool
30 Rotating means
31 Contact roller
32 Electric motor
33 Motor moving means
40 Cutting and grasping device
50 Conveying means
50 Withdrawing means
70 Wire second-end pressing means
71 First pressing means
72 Second pressing means

The invention claimed is:

1. A wire bundling device, comprising:

a plurality of reels configured for being rotated by rotating means for respectively winding a plurality of wires, a first end of each of the wires being engaged with a respective one of the plurality of reels, each of the wires having a predetermined length and being fed from a single spool;

wire second-end pressing means for collecting and pressing the plurality of wires at a second end side of each of the plurality of wires wound around the plurality of reels; and pulling means for pulling, the plurality of wires from the plurality of reels in a state that the plurality of wires is collected and pressed by the wire second-end pressing means; the wire second-end pressing means including:

first pressing means for releasably pressing the wire; and second pressing means, disposed adjacent the first pressing means, for pressing the wire when the wire is released by the first pressing means.

2. The wire bundling device according to claim 1, wherein the rotating means includes:

an electric motor for rotating a contact roller disposed on a rotating shaft thereof, the contact roller being in contact with an outer circumference of each of the reels while rotating; and motor moving means for moving the electric motor so that the contact roller selectively makes contact with the outer circumference of one of the plurality of reels.

3. The wire bundling device according to claim 1, further comprising:

a cutting and grasping device that cuts the wire after winding the wire around one of the reels by a predetermined length the cutting and grasping device grasping one end of the cut wire as a first end of the wire fed from the spool and to be wound around a next reel, the other end of the cut wire becoming the second end of the wire which was wound around the one of the reels by the predetermined length;

wire second-end conveying means for guiding the second end of the wire that was wound around the one of the reels to the wire second-end pressing means; and wire first-end conveying means for moving the first end of the wire grasped by the cutting and grasping device from the cutting and grasping device so as to be engaged with a next reel.

4. A wire bundling method comprising:

a wire winding step of winding, by a predetermined length, a wire fed from a single spool around each of a plurality of reels and then cutting the wire repeatedly such that wires with the predetermined length are each wound around a respective one of the plurality of reels;

the wire winding step includes collecting and pressing a second end of each of the cut wires whenever the respective wire is wound around one of the reels; and a pulling step of bundling a plurality of the wires, each having the predetermined length, wound separately around the plurality of reels and pulling the plurality of wires from the plurality of reels;

the pulling step includes pulling the plurality of the wires from the plurality of reels in a state that the plurality of the wires is collected and pressed at a second end side of each of the wires; and the pressing of the plurality of the wires at the second end side thereof is performed by first pressing means for releasably pressing each of the plurality of the wires and second pressing means, disposed adjacent to the first pressing means, for pressing each of the plurality of the wires at least when the wire is released by the first pressing means.

5. The wire bundling method according to claim 4, further comprising a stretching step of stretching the respective wires pulled from the plurality of reels is performed after the wire winding step but before the pulling step.

* * * * *